US006170355B1

(12) United States Patent
Fay, III

(10) Patent No.: US 6,170,355 B1
(45) Date of Patent: Jan. 9, 2001

(54) ERGONOMIC RANGE ACCOMMODATING ADJUSTABLE FOOT PEDAL

(75) Inventor: William A. Fay, III, East Berlin, PA (US)

(73) Assignee: United Defense, L.P., Arlington, VA (US)

( * ) Notice: Under 35 U.S.C. 154(b), the term of this patent shall be extended for 0 days.

(21) Appl. No.: 09/238,709

(22) Filed: Jan. 28, 1999

(51) Int. Cl.[7] ..... G05G 1/14

(52) U.S. Cl. ..... 74/512; 74/478.5; 74/562

(58) Field of Search ..... 74/478, 478.5, 74/512, 539, 542, 560, 562, 562.5

(56) References Cited

U.S. PATENT DOCUMENTS

| | | | | |
|---|---|---|---|---|
| 3,224,293 | * | 12/1965 | Rose | 74/562.5 |
| 3,273,418 | * | 9/1966 | Ellis | 74/539 |
| 3,643,524 | * | 2/1972 | Herring | 74/560 |
| 3,643,525 | * | 2/1972 | Gibas | 74/560 |
| 3,828,625 | * | 8/1974 | Bruhn, Jr. | 74/560 |
| 4,026,164 | * | 5/1977 | Mozingo | 74/562.5 |
| 4,802,381 | * | 2/1989 | Hsin-hsin | 74/512 |
| 4,870,871 | * | 10/1989 | Ivan | 74/560 |
| 4,875,385 | * | 10/1989 | Sitrin | 74/560 |
| 5,010,782 | * | 4/1991 | Asano et al. | 74/560 |
| 5,078,024 | * | 1/1992 | Cicotte et al. | 74/560 |
| 5,161,430 | * | 11/1992 | Febey | 74/594.1 |
| 5,172,606 | * | 12/1992 | Dzioba et al. | 74/560 |
| 5,253,545 | * | 10/1993 | Barrons et al. | 74/562 |
| 5,351,573 | * | 10/1994 | Cicotte | 74/560 |
| 5,460,061 | * | 10/1995 | Redding et al. | 74/560 |
| 5,583,407 | * | 12/1996 | Yamaguchi | 74/512 |
| 5,632,183 | * | 5/1997 | Rixon et al. | 74/560 |
| 5,697,260 | * | 12/1997 | Rixon et al. | 74/560 |
| 5,901,614 | * | 5/1999 | Ewing | 74/560 |
| 5,927,154 | * | 7/1999 | Elton et al. | 74/560 |
| 5,996,438 | * | 12/1999 | Elton | 74/560 |
| 6,019,015 | * | 2/2000 | Elton | 74/560 |

* cited by examiner

*Primary Examiner*—David Fenstermacher
*Assistant Examiner*—Chong H. Kim
(74) *Attorney, Agent, or Firm*—Ronald C. Kamp

(57) ABSTRACT

The invention provides an easily adjustable foot-operated pedal assembly, such as a brake pedal for use in heavy equipment, that can be placed in multiple positions to accommodate people of differing heights and body shapes. The pedal is mounted in an assembly including a dual linkage operating apparatus having one element of that linkage that freely rotates about a shaft. A second link of the pedal linkage is connected to a fixed link through an adjustment mechanism. The fixed link is fixedly mounted to the same shaft as the pedal link. The adjustment mechanism incorporates a latch that has multiple settings yielding three or more pedal positions. The pedal is urged upwardly to effect adjustment to raise the pedal. A latch bar of the pedal assembly is urged up to allow lowering of the pedal.

7 Claims, 2 Drawing Sheets

ERGONOMIC RANGE ACCOMMODATING ADJUSTABLE FOOT PEDAL

BACKGROUND OF THE INVENTION

The present invention relates to adjustable foot pedals used as operator input devices in various types of equipment. One such application would be as a brake pedal in a heavy duty vehicle, such as a truck, tractor, fork lift truck, or an armored military vehicle.

In machinery of all types and particularly heavy duty vehicles, operators of different heights can be required to operate the machinery. In one applicable embodiment, that being a heavy duty vehicle, a suspended or floor mounted brake pedal is not efficient or comfortable to everyone in the spectrum of individuals that may be asked to operate the vehicle. This is especially true if the seat of the vehicle cannot be adjusted to accommodate persons of different sizes. It is well known to provide a height adjustable brake pedal. Some of these brake pedals or machine operating pedals will have releasable adjusting links on the underside of the brake pedal. Such location could interfere with the movement of the brake pedal.

In addition to the vehicle applications mentioned above it is contemplated that an adjustable pedal of the type disclosed herein could find applicability in other applications. For instance, in a factory environment there are many machines that require foot activated input from the machine operator. In particular situations where the machine operator is sitting in a seat or a chair the adjustability of the foot pedal could be a desirable feature. From an ergonomic standpoint the proper leg extension of the operator can reduce stress related injuries and lead to higher productivity and operator comfort on the job.

Studies have indicated that a significant portion of the male population can be accommodated by a foot pedal design having an extension of a given travel or "throw." For instance, approximately ninety five percent of men in the age group typical of men in the United States military can effectively operate a foot actuated control pedal if the travel or throw of the pedal linkage is restricted to twenty eight degrees and the pedal is adjustable from a positive eighteen degree position to a negative eighteen degree position. This adjustment and travel range is also an effective operating range for five percent of the female population. In the case of heavy machinery operation this population range for both males and females will accommodate the majority of operators.

In a study performed at the FMC Corporate Technology Center in Santa Clara, Calif. in April 1997 the existing M88A2 brake pedal operation was evaluated. Through extensive use of a program called "JACK" (a human figure modeling and analysis software program) the inventors were able to determine the movement, reach and stretch requirements for both ninety-five percent male and five percent female operators. Industry standards and particularly military specification standards such as MIL-STD-1472 were not being attained and accommodated by all pedal systems.

To meet the scope of the range of potential operators of heavy machinery it is desirable to have a foot operated pedal that can have at least three adjustment positions. These would include an intermediate height position, a first extension position, which provides an eighteen degree adjustment up (or positive adjustment) from the intermediate position and a second extension position, which provides an eighteen degree adjustment down (or negative adjustment) from the intermediate adjustment position.

It is also desirable that total travel of the pedal be approximately twenty eight degrees in any adjustable configuration. That is to say that if the throw or travel of the pedal is about twenty eight degrees of rotary or arcuate motion the operation of the pedal linkage will be comfortable and efficient for the normal heavy machinery operator.

SUMMARY OF THE INVENTION

The invention provides a foot pedal using two separate levers or linkage links, which pivot around a common shaft and are connected together by an adjustable latch. The position of the foot pedal relative to the floor of the host vehicle or relative to the seating location of the operator of the host vehicle will be adjustable by means of a notched link in the pedal operating linkage. An arcuate slot in the assemble will prevent the over extension of the linkage thereby providing a mechanism to minimize the opportunity of the pedal getting out of adjustment. That is, the pedal will still have a range of operating travel or scope that will assure the usefulness of the pedal assembly.

One object of the invention to provide an adjustable pedal assemble that will be efficient when used by ninety five percent of all males and of five percent of the females between the ages of eighteen and fifty of the population of United States.

It is another object of the invention to provide a easily adjustable pedal that can be adjusted as the vehicle is being operated.

It is another object of the invention to provide an adjustable pedal that is comfortably accommodates people of different heights when they are seated in non-adjustably operator's seats.

It is another object of the invention to provide an adjustable pedal, where the axis of rotation for adjustment is the same as the axis of rotation in the use of the pedal.

A further object of the invention is to provide a pedal assembly that will have the same range of operating motion at each end of the adjustment range, that is that regardless of the position of the pedal adjustment location there will still be a range of pedal motion that will be sufficient to operate the downstream mechanism controlled by the pedal linkage.

On other object of the invention is to provide a heavy duty pedal assemble that is purely mechanical in operation making it appropriate for use in heavy duty operating environments.

It is also an object of the invention to provide a pedal design that limits total pedal travel from the existing fifty degrees of pedal travel to a new total travel of approximately twenty-eight degrees of arcuate pedal travel regardless of the pedal adjusted stop position.

BRIEF DESCRIPTION OF THE DRAWINGS

The invention will be understood through a reading of this specification in conjunction with a perusal of the following drawing figures. Unless specifically noted, it is intended that the words and phrases in the specification and the claims are given the ordinary and accustomed meaning to those of ordinary skill in the applicable arts. If any other special meaning is intended for any word or phrase, the specification will clearly state and define the special meaning.

Likewise, the use of the words "function" or "means" in the Detailed Description of the Drawings is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to invoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, material or acts for performing the claimed function.

Figure 1:
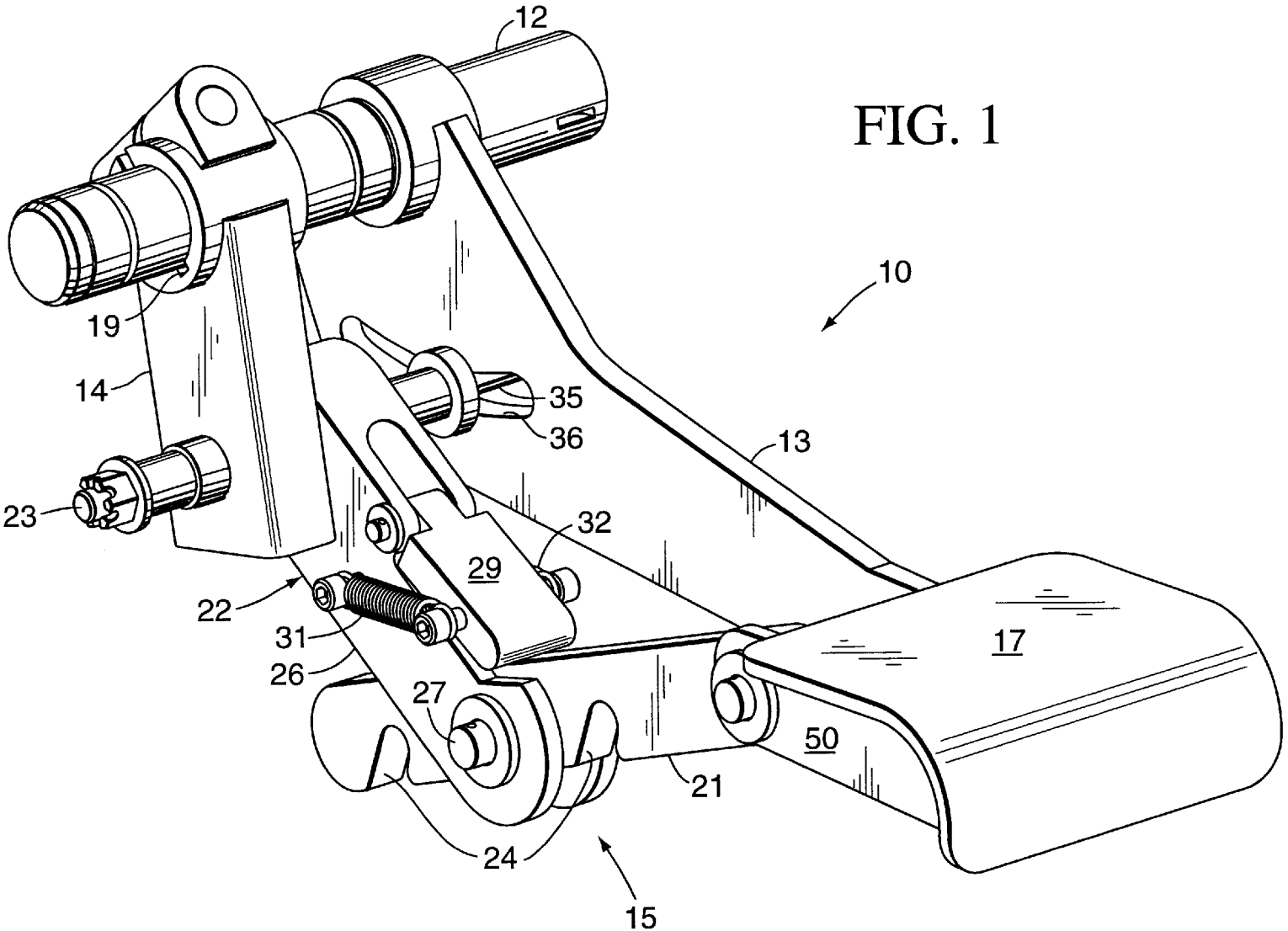
Figure 2:
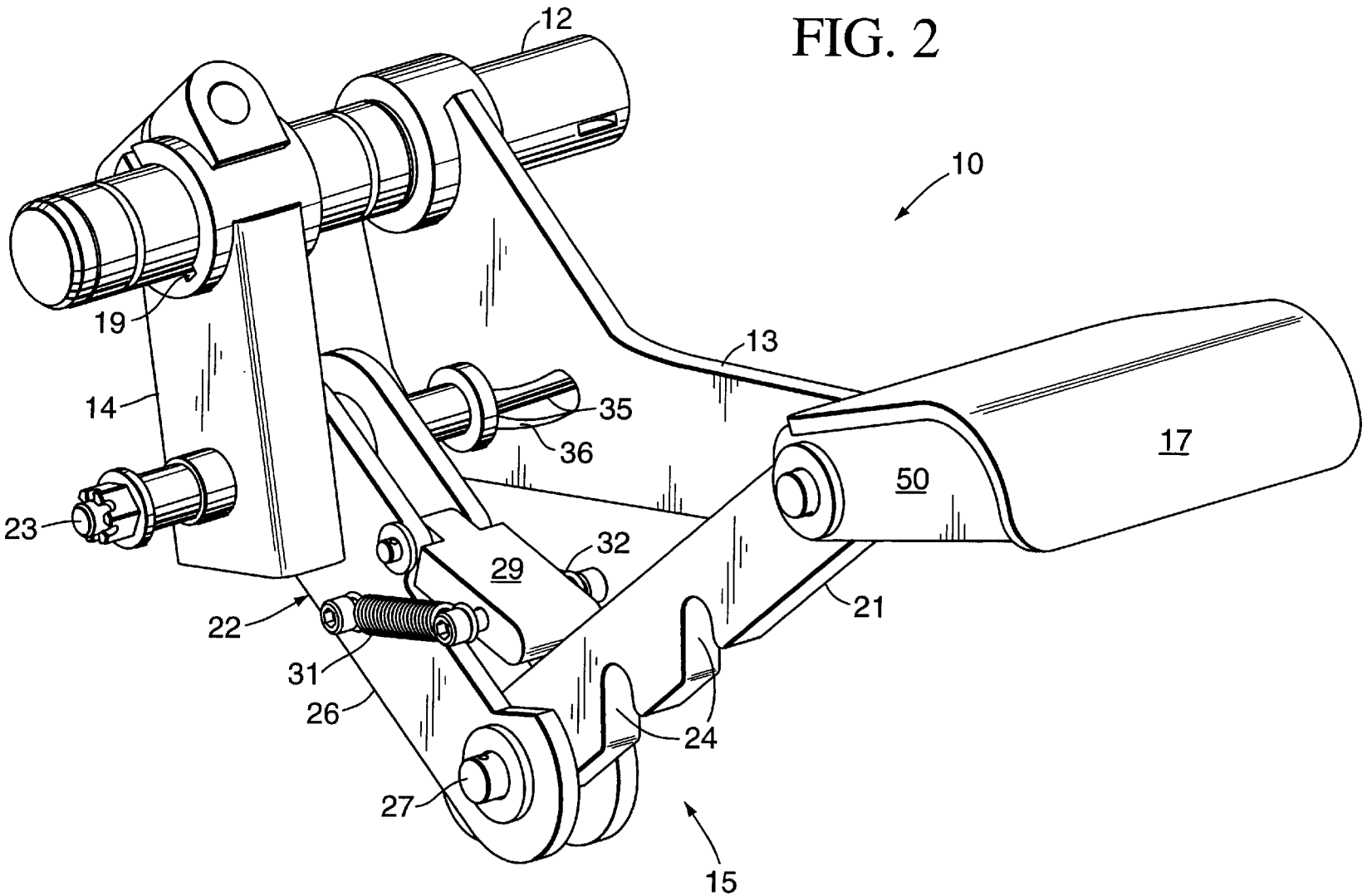

The drawing figures presented herein for illustration purposes include:

FIG. 1 is a perspective view of a preferred embodiment of the foot operated pedal assembly in a position intermediate two extremes of adjustment;

FIG. 2 is a perspective view of the foot operated pedal assembly shown in FIG. 1 adjusted to an extreme position wherein the pedal is in a "high" position.

DESCRIPTION OF THE PREFERRED EMBODIMENTS

FIG. 1 is a perspective view of a preferred embodiment of an adjustable pedal assembly 10, comprising a shaft 12, a pedal link or lever 13, a fixed link or lever 14, and a adjusting mechanism 15. The pedal lever link 13 has a first end and a second end. The first end of the pedal link 13 is rotatably mounted to the shaft 12, so that the pedal link 13 may rotate with respect to the shaft 12, with the shaft 12 being the center of rotation for the pedal link 13. The second end of the pedal link 13 supports a pedal 17. The fixed link 14 has a first end and a second end. The first end of the fixed link 14 is fixed to the shaft 12 so that the fixed link 14 cannot rotate freely with respect to the shaft 12. Displacement of the fixed link 14 perpendicular to the center line of the shaft 12 causes rotation of the shaft 12. In the preferred embodiment, a key 19, kept in a keyway formed in the shaft is used to fix the fixed link 14 to the shaft 12. The shaft 12 is connected to linkage of a brake system of a heavy duty vehicle.

The adjusting mechanism 15 is connected between the second end of the pedal link 13 and the second end of the fixed link 14. In this embodiment, the adjusting mechanism 15 comprises a latch bar 21 and a latch mechanism generally 22. The first end of the latch bar 21 is mechanically connected to the second end of the pedal link 13, through a mounting bracket 50. The latch bar 21 is freely rotatable with respect to the pedal link 13. The latch bar 21 has three notches, two visible and marked as 24. Fewer or more notches could be used to increase the range of selections available however in the preferred embodiment three notches has worked well. These notches 24 extend from a center line, not shown, in the latch bar 21 to a bottom edge of the latch bar 21. The notches are angled so that going from the center line to the bottom edge of the latch bar the notches 24 are angled towards the first end of the latch bar 21 which is the end furthest away from the pedal assembly. The latch mechanism, generally 22, comprises a support bar 26 having a first end and a second end.

The first end of the support bar 26 is rotatably connected to the second end of the fixed link 14.

The second end of the support bar 26 is split in the fashion of a clevis, so that the support bar 26 forms a "Y" shape. The latch bar 21 is restrained in the clevis gap, slot or space of the support bar 26. A catch, comprising a clevis pin 27, is connected to the second end of the support bar 26. The pin 27 bridges the clevis gap or split in the support bar 26. The clevis pin 27 is a diameter that allows the clevis pin 27 to fit into each of the three notches 24. The latch bar 21 is inboard in the clevis slot relative to the clevis pin 27 location, as shown in FIG. 1.

A hinge mounted pawl 29 is rotatably connected to the support bar 26, so that the pawl 29 rests on and is urged against the latch bar 21 in the normal operating mode of the pedal latch assembly. A first spring 31 is connected between the pawl 29 and the support bar 26 on a first side of the support bar 26, and a second spring 32 is connected between the pawl 29 and the support bar 26 on a second side of the support bar 26. The springs are anchored at one end to the support bar 26 and at the other end to a location on the pawl 29 outboard of the hinge pin or pivot point of the pawl 29 to support bar 26 with the spring line relatively below the pawl pivot point. This will urge the pawl 29 to rotate toward the support bar and keep tension on latch bar 21.

A first end of the support bar shaft 23, in the form of a shaft 35, forms a stop means link which is inserted through the arcuate aperture 36 in the pedal link 13.

In operation, the adjustment point of the pedal assembly 10 embodied in FIG. 1 is in either a first, second, or third position. FIG. 1 shows the pedal assembly 10 in the second position, with the clevis pin 27 being in the second notch of the latch bar 21.

When a force is applied to the pedal 17 in a downward motion, the pedal link 13 rotates around the shaft 12 in a clockwise direction as shown in the projection. The movement of the pedal link 13, puts a compression force on the latch bar 21. The compression force on the latch bar 21 places a force at the second notch onto the clevis pin 27. The angle of the notches 24 prevents the compression force from moving the clevis pin 27 out of the second notch. The force on the clevis pin 27 causes the fixed link 14 to also rotate in a clockwise direction. This will result in shaft 12 rotation in a clockwise direction, which causes the shaft 12 to initiate operation of the downstream mechanism such as a master cylinder in a hydraulic braking system.

To raise the pedal 17 from the intermediate position shown in FIG. 1 to the extreme position shown in FIG. 2, the operator's foot is used to displace the pedal 17 upward, which causes the pedal link 13 to rotate around the shaft 12 in a counter clockwise direction. The movement of the pedal link 13, pulls the latch bar 21 towards the pedal 17. Since the pedal link 13 is not fixed to the shaft 12, the shaft 12 and the fixed link 14 remain stationary. As the latch bar 21 moves in the direction of the pedal 17, the angle of the second notch allows the clevis pin 27 to push up on the link bar 21 moving the link bar 21 upward against the pawl 29 and forces from the first and second springs 31, 32. When the latch bar 21 reaches sufficient height, the clevis pin 27 escapes from the confines of the second notch and the latch bar 21 is moved so that the third notch is moved towards the clevis pin 27. When the opening of third notch reaches the clevis pin 27, the follower 35 reaches a first end of the aperture 36, which prevents the pedal link 13 from being moved any further. When the upward force, generated by an operator's foot or hand, on the pedal 17 is removed, gravity forces acting on the pedal link 13 pulls the pedal 17 downward, which rotates the pedal link 13 in a clockwise direction, causing the pedal link 13 to push on the latch bar 21. In addition to the force of gravity on the latch bar 21, the pawl 29 and forces from the first and second springs 31, 32 causes the clevis pin 27 to slide into the third notch, as shown in FIG. 2.

When a force is applied to the pedal 17 in a downward motion, such as when an operator depresses the pedal, the pedal link 13 rotates around the shaft 12 in a clockwise direction. The movement of the pedal link 13, puts a compression force on the latch bar 21. The compression force on the latch bar 21 places a force at the third notch onto the clevis pin 27. The angle of the notches 24 prevents the force from moving the clevis pin 27 out of the second notch. The force on the clevis pin 27 causes the fixed link 14 to rotate in a clockwise direction. This will rotate the shaft 12 in a clockwise direction, which causes the shaft 12 to rotate as well and ultimately initiate braking.

To lower the pedal 17 from the third position, so that the pedal assembly 10 is able to accommodate people that prefer a lower pedal location, the operator's foot or hand is used to displace the latch bar 21 upward against the forces of gravity and the pawl 29 with its first and second springs 31, 32. This will cause the clevis pin 27 to become disengaged from the third notch. The force of gravity on the pedal link 13 causes the pedal link 13 to rotate in a clockwise direction, which pushes on and moves the link bar 21 until the follower 35 reaches a second end of the aperture 36. The interference between the follower 35 and the second end of the slot 36 prevents the pedal link 13 from being moved any further. When the upward force on the latch bar 21 is removed, gravity on the latch bar 21 and pawl 29 and the forces from the first and second springs 31, 32 pull the latch bar 21 downward, so that the clevis pin 27 enters the first notch. The first notch location representing the extreme of travel in the bottom or lowest position.

When a force is applied by an operator to the pedal 17 in a downward motion, the pedal link 13 rotates around the shaft 12 in a clockwise direction. The movement of the pedal link 13, puts a compression force on the latch bar 21. The compression force on the latch bar 21 places a force from the first notch onto the clevis pin 27. The angle of the notches 24 prevents the force from releasing the clevis pin 27 from its location in the first notch. The force on the clevis pin 27 causes the fixed link 14 to rotate in a clockwise direction, which rotates the shaft 12 in a clockwise direction. This causes the shaft 12 to initiate linkage displacement with resulting braking in an embodiment used to actuate a brake.

Because the preferred embodiment set forth in this specification does not use a link directly below the pedal, the pedal location relative to a floor surface may be relatively close. Since the fixed link 14 and the pedal link 13 have the same axis of rotation, all the force applied to pedal is transferred to the brake system. Given this geometry the position of the pedal in its adjustment location will not cause an increase the angle of travel.

As can be scene from the above disclosure the pedal assembly is easy to adjust. Simply pulling up on the pedal will move the adjustable pedal from the "lowest" position to the intermediate position or from the intermediate position to the "highest" position. To move the pedal from the "highest" position to the intermediate position or from the intermediate position to the "lowest" position the operator will simply lift up on the latch bar 21. The follower and aperture, prevent the pedal from being moved too far.

Other embodiments of the invention may use other adjusting mechanisms connected between the fixed link and the pedal link. The aperture 36 in the pedal link 13 forms a cam. Other types of follower and cam devices may be used. The plurality of notches on the latch bar may be replaced by a plurality of pegs, with the single clevis pin being replaced by a single notch in the clevis gap or space. Therefore, the single clevis pin may be a bar or a notch or other device. Latching pin interfaces can be a plurality of notches or pegs or other devices that can be caught by a latching device allowing a plurality of adjustable positions. The latch bar may have two or more adjustable positions.

While the preferred embodiment of the present invention has been shown and described herein, it will be appreciated that various changes and modifications may be made therein without departing from the spirit of the invention as defined by the scope of the appended claims. For instance, the preferred embodiment is disclosed in the context of a brake pedal assembly for use in a heavy duty vehicle. The invention of the adjustable pedal linkage could find equal applicability in foot operated equipment such as production work stations in a manufacturing environment. Such alternative embodiments are contemplated by the inventor.

What is claimed is:

1. An adjustable pedal linkage assembly comprising:

a shaft;

a fixed link with a first end and a second end, wherein the first end of the fixed link is fixedly connected to the shaft;

a pedal link with a first end and a second end, wherein the first end of the pedal link is rotatably connected to the shaft;

a foot pedal mechanically connected to second end of the pedal link;

a support bar rotatably connected to the second end of the fixed link;

a latch bar pinned to the foot pedal having a plurality of catch setting interfaces, each of said plurality of interfaces formed by a notch;

a clevis pin carried by said support bar and engageable with each notch; and a spring loaded pawl for releasably holding the clevis pin in a selected one of said plurality of notches.

2. An adjustable pedal linkage assembly comprising:

a shaft;

a fixed link non-rotatably affixed to said shaft;

a pedal link supported by and rotatable on said shaft;

a foot pedal attached to said pedal link;

a support bar rotatably attached to said fixed link;

a latch bar pinned to the foot pedal and having a plurality of notches formed therein;

a clevis pin carried by said support bar and engageable with each of said notches; and a spring loaded pawl for releasably holding the clevis pin in a selected one of said plurality of notches.

3. An adjustable pedal linkage assembly comprising:

a shaft;

a fixed link non-rotatably affixed to said shaft;

a pedal link supported by and rotatable on said shaft;

a foot pedal attached to said pedal link;

a support bar rotatably attached to said fixed link;

a latch bar pinned to the foot pedal and having a plurality of notches formed therein;

a clevis pin carried by said support bar and engageable with each of said notches;

a spring loaded pawl for releasably holding the clevis pin in a selected one of said plurality of notches; and a stop for limiting rotation of said pedal link relative to said fixed link.

4. The invention according to claim 3, wherein said stop comprises:

a circular slot in said pedal link; and a stop pin affixed to said fixed link and extending through said slot.

5. The invention according to claim 4, wherein said stop pin extends through said support bar to rotatably attach said support bar to said fixed link.

6. The pedal assembly, as set forth in claim 1, further comprising a follower and cam assembly connected between the fixed link and the pedal link.

7. The pedal assembly, as set forth in claim 2, further comprising a follower and cam assembly connected between the fixed link and the pedal link.

* * * * *